US010941999B1

(12) United States Patent
Termanini

(10) Patent No.: US 10,941,999 B1
(45) Date of Patent: Mar. 9, 2021

(54) DEVICE FOR REDUCING RECOIL OF FIREARM

(71) Applicant: Zafer Termanini, Port Saint Lucie, FL (US)

(72) Inventor: Zafer Termanini, Port Saint Lucie, FL (US)

( * ) Notice: Subject to any disclaimer, the term of this patent is extended or adjusted under 35 U.S.C. 154(b) by 0 days.

(21) Appl. No.: 16/819,090

(22) Filed: Mar. 14, 2020

(51) Int. Cl.
*F41A 21/38* (2006.01)

(52) U.S. Cl.
CPC ..... *F41A 21/38* (2013.01)

(58) Field of Classification Search
CPC ..... F41A 21/38; F41A 21/26; F41A 21/36
See application file for complete search history.

(56) References Cited

U.S. PATENT DOCUMENTS 4,833,808 A * 5/1989 Strahan ..... F41A 21/28 42/1.06
4,977,815 A * 12/1990 Stephens ..... F41A 3/62 42/16
5,123,329 A * 6/1992 Irwin ..... F41A 5/16 89/14.3
5,303,634 A * 4/1994 Warner ..... F41A 21/34 89/14.2
6,276,251 B1 * 8/2001 Downing ..... F41A 21/36 89/14.3
8,387,299 B1 * 3/2013 Brittingham ..... F41A 21/325 42/90
2007/0095198 A1 * 5/2007 Dater ..... F41A 21/325 89/14.2
2011/0088540 A1 * 4/2011 Brittingham ..... F41A 21/30 89/14.5
2011/0252952 A1 * 10/2011 McNeill ..... F41A 21/38 89/14.3
2014/0173963 A1 * 6/2014 Kent ..... F41A 21/26 42/90
2016/0123689 A1 * 5/2016 Maeda ..... F41A 21/36 89/14.3
2017/0314883 A1 * 11/2017 Whitfield, Jr. ..... F41A 21/28
2018/0120045 A1 * 5/2018 Rost ..... F41A 21/34
2018/0347926 A1 * 12/2018 Lopatin ..... F41A 3/26
2019/0353447 A1 * 11/2019 Palenik, II ..... F41A 21/38
2020/0141681 A1 * 5/2020 Na ..... F41A 21/36
2020/0173752 A1 * 6/2020 Wolf ..... F41A 21/325
2020/0232740 A1 * 7/2020 Honigmann ..... F41A 21/30

* cited by examiner

*Primary Examiner* — Michelle Clement
(74) *Attorney, Agent, or Firm* — Samir Termanini, Esq.

(57) ABSTRACT

A recoil reducer device for use with a firearm is provided comprising a heavy weighted doughnut situated in a cylinder which is screwed onto the muzzle of the barrel. The exhaust gases as they exit the muzzle will enter the base of the cylinder through side portals and forcefully push the doughnut forward striking the base plate of the cylinder thereby pushing the recoil reducer device forward considerably reducing the recoil force generated by the fired bullet. A spring inside the cylinder will push back the weighted doughnut to its original position.

10 Claims, 4 Drawing Sheets

DEVICE FOR REDUCING RECOIL OF FIREARM

The present invention relates to firearms, and more particularly to a device used in connection with a firearm for reducing the recoil force generated by discharging the firearm.

BACKGROUND OF THE INVENTION

Since the introduction of the black powder from China to Europe in the $12^{th}$ century by Marco Polo gun powder have been used to propel projectiles using canons and heavy armors. Subsequently firearms evolved to include shoulder mounted contraptions such as "arquebuse", muskets and muzzle loader where black powder was utilized to propel honed stones, metallic balls and alike. Smokeless gun powder or cordite was introduced in the mid 1800 providing significant improvement in the modern firearm industry as we know it today. When smokeless powder is ignited, it will generate considerable volume of gas, which is used to propel the projectile through the barrel and out through the muzzle. At the same time however, the expending gases in the chamber will also push the cartridge and the barrel backward generating recoil force felt by the shooter.

According to Newton's Laws of mechanics, for every action there is an equal and opposite reaction. It is further understood that the larger the amount of powder and the mass of the projectile the higher the recoil force. Shoulder mounted firearms such as rifles and shotguns use larger projectiles than handguns therefore the recoil felt by the operator is more significant. The recoil force generated will "kick" the stock of the firearm backward causing pain to the gun operator, especially when large caliber projectile is used. Significantly more damaging is when the operator of the gun uses the firearm in the prone position thereby eliminating the shoulder which act as a "shock absorber". This may lead to serious injury to the operator's shoulder such as fracture of the collar bone. The significant recoil force will cause the muzzle of the gun to "jump" upward, which reduces accuracy especially for a following shot. Furthermore, repetitive shooting such as target shooting is less pleasant when shooting large caliber magnum ammunition.

Several recoil reducers have been generously described in the prior art. The majority of said devices are situated in the stock of the firearm and utilize rebound kinetic energy of a mass and a recoil spring.

Upon discharging the firearm, the kinetic spring is compressed and accumulate energy, which is released subsequently However, the mass and recoil spring does not offer substantial reduction of the recoil force because of the significant delay in the recoil which reduces the effectiveness of spring recoil mechanism.

Other firearms, such as automatic rifles and shotguns have the inertial operation mechanism situated in the forestock of the firearm and its release is closely associated with the trigger release at the time of firing (U.S. Pat. No. 6,550,173 B2).

Other recoil reducers redirect the muzzle blast gases are screwed to the fore end of the barrel for the purpose of dispersing the gases and allow them to exit side way thereby reducing the exhaust from the front. Other recoil reducers orient the exhaust gases backward toward the shooter, which results in detrimental effects such as extremely loud sound blast or having particle or residue of unburnt gun powder redirected backward toward the shooter or bystanders at the range. Exhaust ports that are oriented downward are notorious for kicking up dirt when operator is firing from a prone position. The dirt may harm the shooter and make a second follow up shot difficult.

Other recoil reducers redirect gases from the barrel into mass and spring mechanism, which reduces the amount of gases propelling the bullet before it exits the muzzle, which may reduce ultimate velocity and performance of the bullet.

Additionally, the present invention has tendency to reduce the noise generated from the muzzle blast. This is accomplished by partial and gradual release of the gases and rerouting them through the recoil reducing device exhaust holes.

It is the object of this present invention to provide a recoil reducing device that is generally reliable, relatively easy to manufacture and simple to maintain.

SUMMARY OF THE INVENTION

The purpose of the present invention is to provide a recoil reducing device for use with a firearm. The recoil reduction device, which is easily screwed onto the distal end of the barrel includes an outer cylinder having a slidable weighted circular ring, which slides into said cylinder. A central cylinder having a diameter slightly larger than the bore of the barrel through which the bullet will exit upon discharge. The central cylinder provides radially situated opening to allow portion of the discharge gases to enter the outer cylinder. Said opening is adjacent to the end of the gun barrel. The compressed gases behind the exiting bullet will enter the radial opening and push the weighted ring distally. In doing so, the weighted ring will be forcefully pushed distally with considerable force striking the base of the outer cylinder and causing the gun barrel to move forward and away from the shooter. After pushing the weighted ring all the way to the end of the outer cylinder the gases will escape through lateral ports 8 and 10 allowing said weighted ring to be pushed back. The spring will push the weighted ring back and return it to its original position. It takes the bullet approximately 70 microseconds to travel an average length barrel until the recoil reducing device begins to function. This delay is too brief to be noticed by the shooter, who will feel instant reduction of the recoil when the weighted ring is forcefully pushed forward. It is to be noted that the device of the present invention does not affect the accuracy of the firearm since it does not reduce the amount of propelling gases and act on the recoil after the bullet has exited the bore.

A primary object of the present invention is to provide a recoil reducing device that will overcome the shortcomings of the prior art devices. Other objects and advantages of the present invention will become obvious to the reader and it is intended that these objects and advantages are within the scope of the present invention. The device of the present invention may be used with rifles, shotguns as well as handguns.

To the accomplishment of the above and related objects, this invention may be embodied in the form elicited in the accompanying drawings, attention being called to the fact, however, that the drawings are illustrative only and that changes may be made in the specific construction illustrated.

BRIEF DESCRIPTION OF THE DRAWINGS

The features and advantages of the present invention will become apparent to those skilled in the art upon a review of the accompanying drawings, wherein.

Like reference numbers and designations in the various drawings indicate like elements.

DETAILED DESCRIPTION OF THE PRESENT INVENTION

Figure 1:
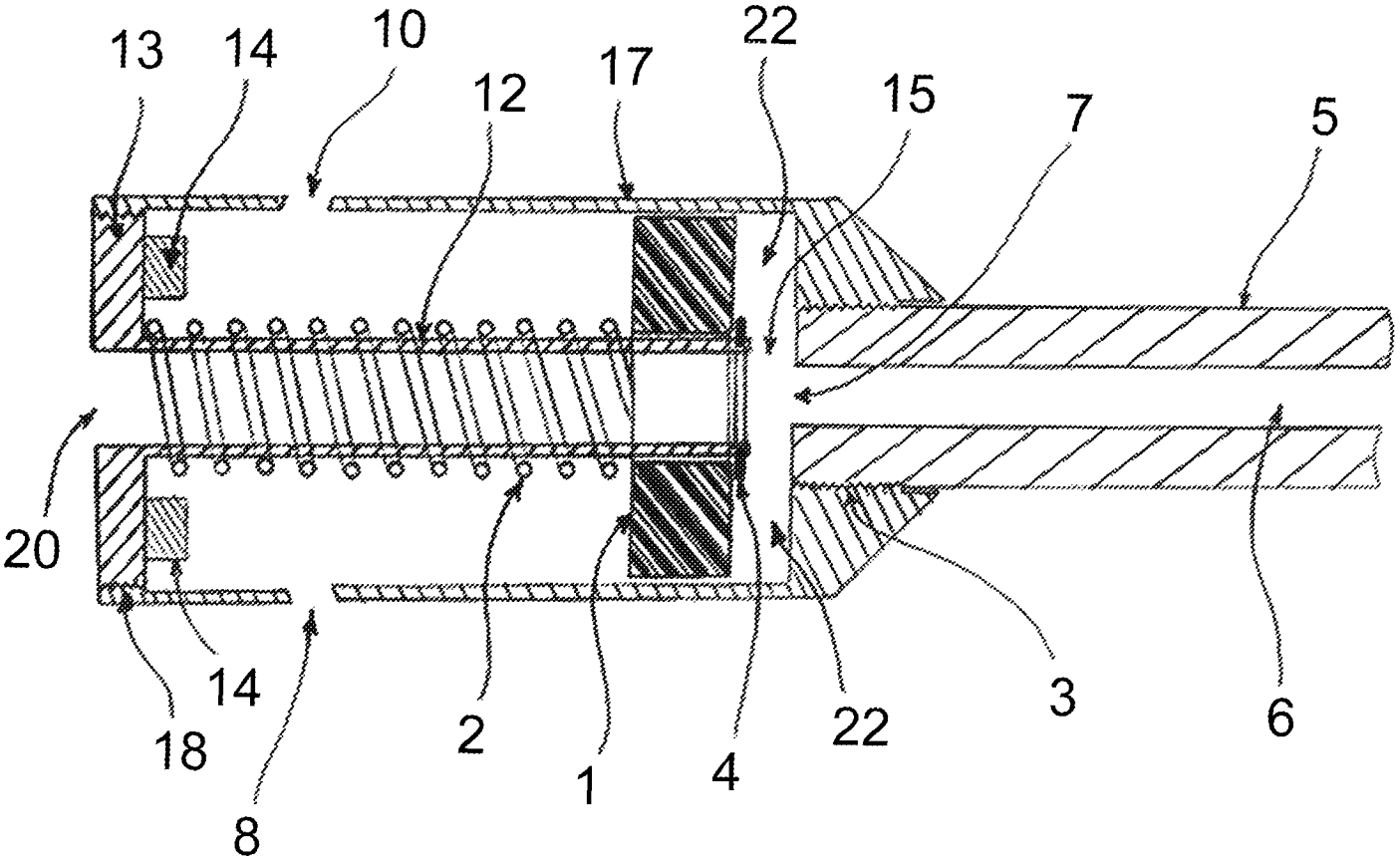
FIG. 1 is a side sectional view of the recoil reducing mechanism of the present invention.

The recoil reducing device of this invention is intended to reduce the recoil force generated by the burning gun powder used for propelling the bullet through the barrel and out the muzzle. The device is easily screwed onto the muzzle of the barrel 6 via threads 25. The pressure in the combustion chamber can exceed 50,000 psi. As the bullet travels through barrel 6 and exit the muzzle 7 of the barrel, significant portion of the exhaust gases will be diverted to penetrate opening 12, situated in a circular fashion in front of muzzle 7. Said exhaust gazes will penetrate into the circular compression chamber 22 and push the circular weighted ring 1 forward toward the fore end of the rifle. Said circular ring having the shape of a doughnut made out of metal which has been rendered heavier by making it hollow and filling it up with lead, bismuth or even mercury. The circular weighted ring (doughnut) 1 will travel forward until it strikes a resilient circular rubber ring 14, which is firmly fixed against the base 13 of the distal end of the device FIG. 1. In doing so, the forward kinetic energy of the weighted ring 1 will be transferred to circular base 13. Said circular base 13 is screwed to outer cylinder 17 via threads 18 (FIG. 1). Holes 10 and 8 of appropriate size and number located in a circular fashion on the periphery of outer cylinder 17 will allow the exhaust gases from the compression chamber 24 to escape after pushing the circular weighted ring 1 forward until it strikes the circular rubber ring 14. Subsequently, springs 2 will push the circular weighted ring 1 backward to its initial position until it rests against circular stop 4. A circular stop ring 4 will prevent the movement of the weighted ring beyond the end of the inner cylinder (FIG. 1).

Figure 2:
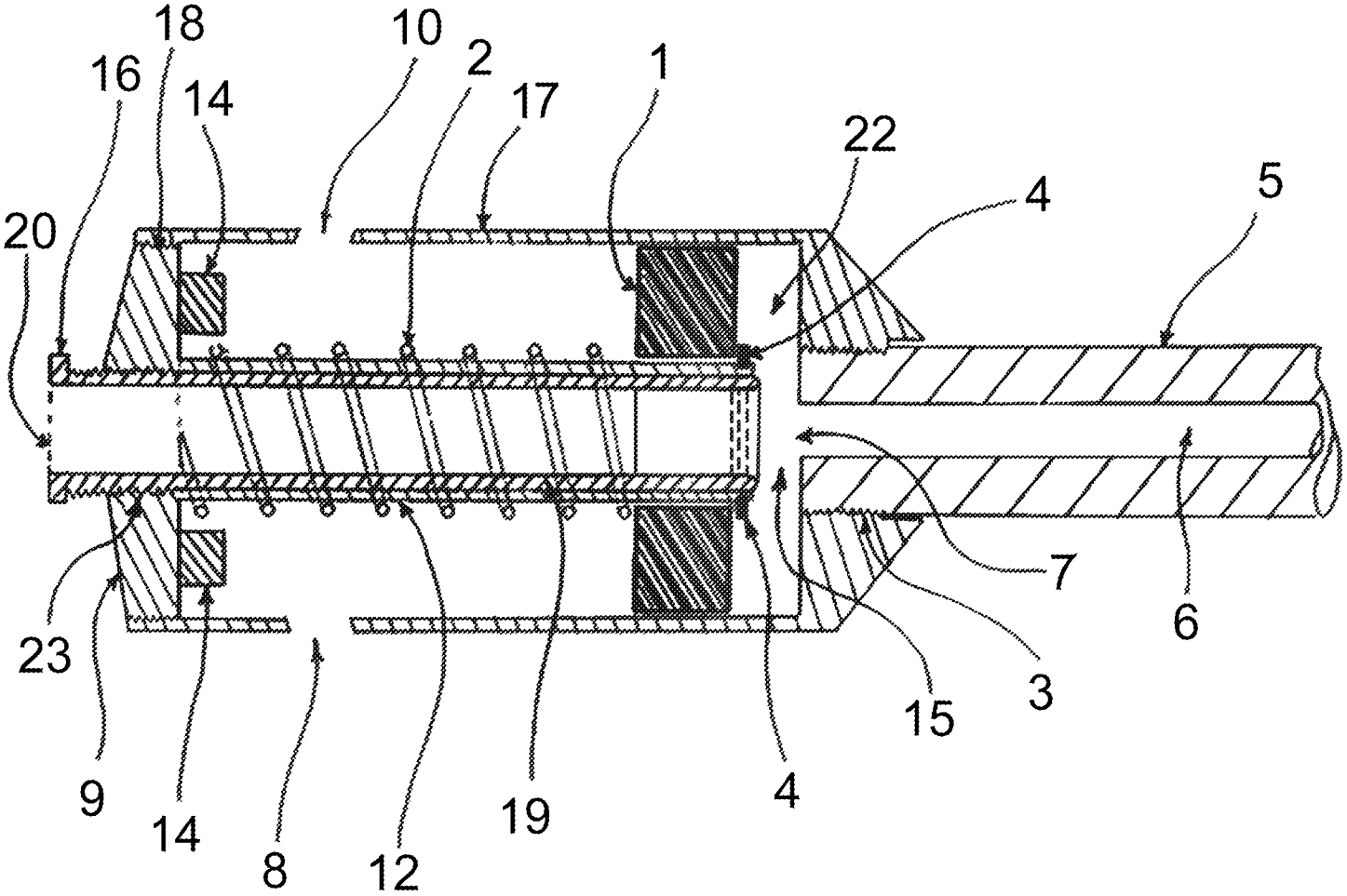
FIG. 2 is a side sectional view of the recoil reducing mechanism showing the gazes controlling central cylinder.
Figure 3:
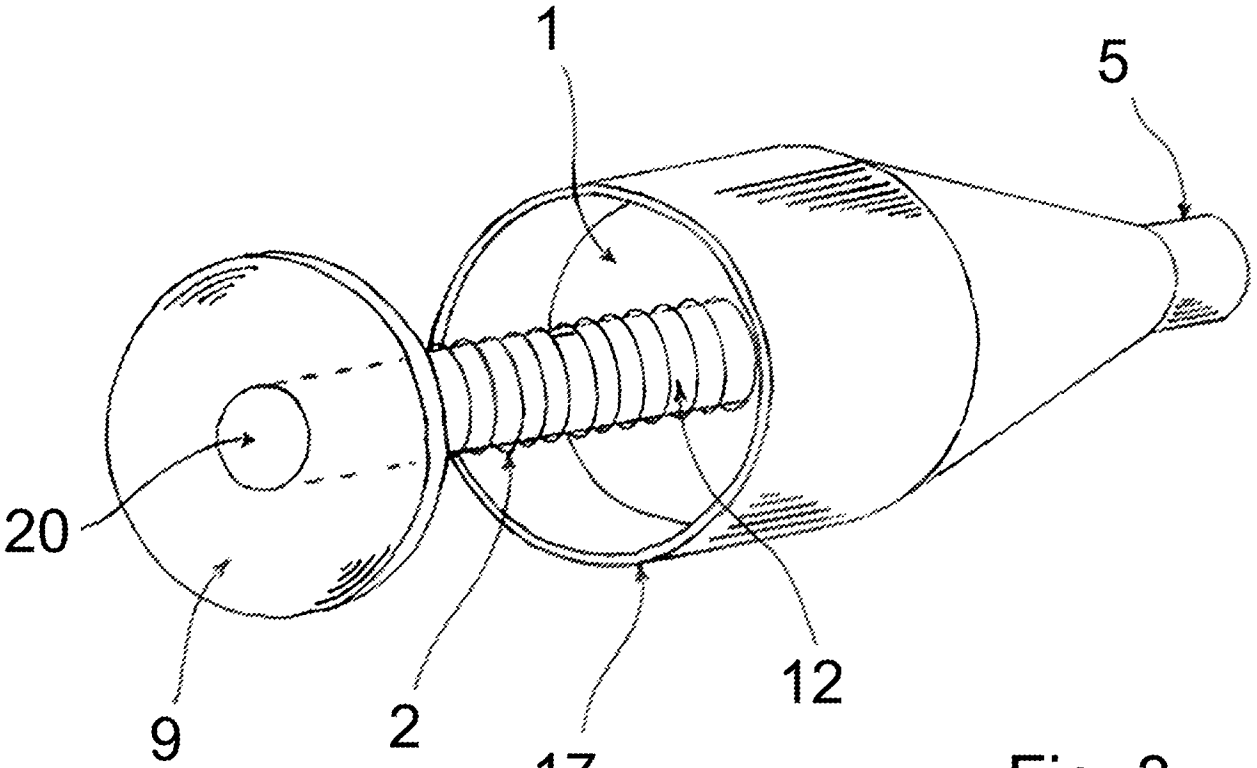
FIG. 3 is a perspective view from above of the recoil reducing device illustrating the weighted ring (doughnut) and return spring.
Figure 4:
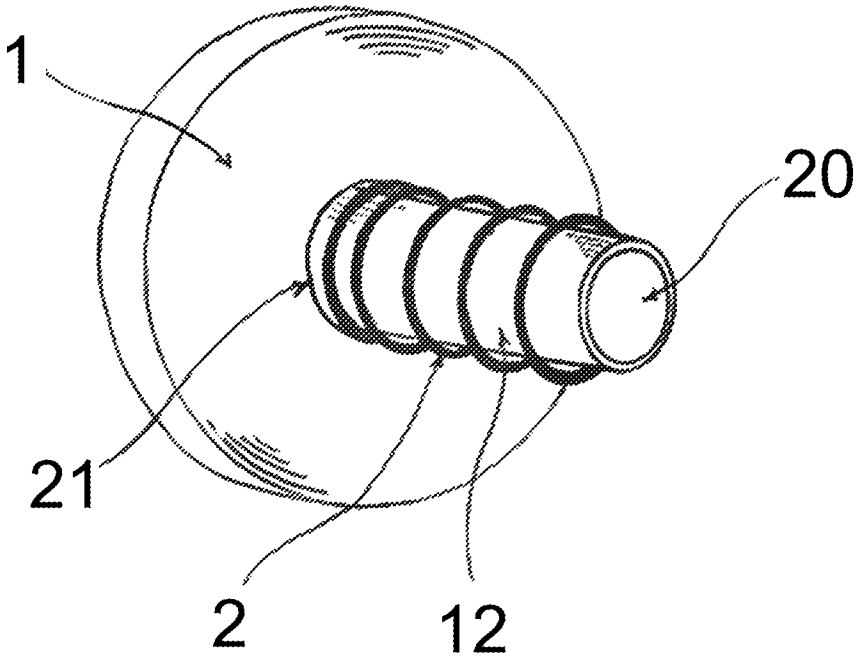
FIG. 4 is an oblique perspective view of the weighted ring, central cylinder and return spring.

In a different embodiment of the present invention, the volume of exhaust gases which enters the compression chamber 22 can be reduced thereby controlling the anti-recoil force. This is advantageous when using small calibers or lighter bullet. This is accomplished by having a central cylinder 19 threaded distally to endplate 9 via threads 23 (FIG. 2). Turning the knurled end 16 will move the cylinder 19 deeper thereby reducing the opening 15. Consequently, there will be less exhaust gases entering the chamber 22 transferring less kinetic energy to the weighted ring 1.

It is clear that numerous variations may be made to the above described recoil reducing device without thereby departing from the principles of novelty inherent in the inventive idea. For example, the present disclosure's teachings may be used in rifles, shotguns or handguns.

The material, shapes and dimensions of the items illustrated maybe any whatsoever according to the requirement, and the said items maybe replaced with others that are technically equivalent may be replaced with others that are technically equivalent.

What is claimed:

1. A recoil reducing device coupled to the front end of a firearm comprising:

a hollow outer cylinder having a forward end and a rearward end, said rearward end configured to be coupled to a barrel of the firearm;

a hollow inner cylinder situated within said outer cylinder having a forward end and a rearward end, said forward end having a circular plate to be coupled to the forward end of said outer cylinder;

a weighted ring in a form of a doughnut situated in the space between the outer and the inner cylinder, and is slidably engage the outer periphery of said inner cylinder;

a return spring for pushing said weighted ring rearward to its original position; and a resilient circular bumper firmly attached to the inside surface of the forward end of the circular plate of the inner cylinder as strike plate with the doughnut, wherein the body of said weighted doughnut is hollow and filled with heavy metal such as lead, bismuth, or mercury in order to increase its mass and make it heavy.

2. The recoil reducing device of claim 1 wherein the rearward end of said outer cylinder is internally threaded to allow coupling to said barrel; and said forward end of said outer cylinder is internally threaded to receive a circular plate of the inner tube wherein said circular plate having external threads.

3. The recoil reducing device of claim 1, wherein the inner cylinder further comprises a resilient rubber ring acting as a bumper to reduce the impact forces from the weighted doughnut as it is forcefully pushed forward by exhaust gases.

4. The recoil reducing device of claim 1, wherein the weighted doughnut's center provides a central hole for passage of the inner tube.

5. The recoil reducing device of claim 1, wherein the weighted doughnut is free to slidably move in the cylindrical space situated between the outer and the inner cylinder.

6. The recoil reducing device of claim 1, wherein the return spring is situated around the inner cylinder and is situated forward to the weighted doughnut.

7. The recoil reducing device of claim 1, wherein the rearward end of said inner cylinder further comprises an external snap ring to stop the weighted doughnut and prevent it from going back too far.

8. The recoil reducing device of claim 1, wherein the outer cylinder provides a plurality of gas exhaust orifices oriented outward allowing the exhaust gases to escape after pushing the weighted doughnut forward.

9. The recoil reducing device of claim 1, further comprising a central cylinder coupled at the forward end of said inner cylinder for restricting the amount of exhaust gases entering a compression chamber by causing the doughnut position to be adjusted in order to control the amount of gases entering the compression chamber of the recoil device.

10. The recoil reducing device of claim 9, wherein the central cylinder has a knurled end and coupled distally to the base plate of the inner cylinder allowing a shooter to reduce or increase the recoil by twisting said knurled end of central cylinder thereby restricting or increasing the volume of gases entering the compression chamber.

* * * * *